United States Patent [19]

Sayles et al.

[11] Patent Number: 4,468,975

[45] Date of Patent: Sep. 4, 1984

[54] GAUGE WELL FLOAT FOR FLOATING ROOF STORAGE TANKS

[75] Inventors: James A. Sayles, Kensington; William J. Norwood, III, Rodeo, both of Calif.

[73] Assignee: Chevron Research Company, San Francisco, Calif.

[21] Appl. No.: 406,511

[22] Filed: Aug. 9, 1982

[51] Int. Cl.[3] ..... B65D 87/18; G01N 1/16

[52] U.S. Cl. ..... 73/863.81; 33/126.4 A; 73/306; 220/227

[58] Field of Search ..... 73/305, 306, 307, 319, 73/321, 863.85, 863.81; 220/216, 227

[56] References Cited

U.S. PATENT DOCUMENTS

| | | | |
|---|---|---|---|
| 70,312 | 10/1867 | Amsden | 73/321 |
| 981,434 | 1/1911 | Lander | 73/321 |
| 1,879,805 | 9/1932 | Jones | 73/321 |
| 1,972,120 | 9/1934 | Wiggins et al. | 73/321 |
| 2,237,462 | 4/1941 | Tokheim | 73/321 |
| 2,587,526 | 2/1952 | Quist | 73/321 |
| 2,611,270 | 9/1952 | Sciford | 73/321 |
| 2,957,347 | 10/1960 | Bergstrom | 73/321 |
| 3,240,064 | 3/1966 | Sharp | 73/321 |
| 3,862,701 | 1/1975 | Strung et al. | 220/227 |
| 4,197,744 | 4/1980 | Overstreet | 33/126.4 A X |

FOREIGN PATENT DOCUMENTS

| | | | |
|---|---|---|---|
| 0401302 | 8/1942 | Italy | 73/321 |

*Primary Examiner*—Daniel M. Yasich

*Attorney, Agent, or Firm*—Burns, Doane, Swecker & Mathis

[57] ABSTRACT

A gauge well float includes a sealed cylinder having rounded ends. A tube is disposed along the vertical axis of the cylinder and held in place by the rounded ends. A weighted cable suspended within the gauge well passes through the tube and keeps the float centered within the gauge well. It also provides a means for removing the float from the gauge well for level measurement or sampling purposes.

8 Claims, 4 Drawing Figures

GAUGE WELL FLOAT FOR FLOATING ROOF STORAGE TANKS

BACKGROUND OF THE INVENTION

The present invention generally relates to the art of floating roof storage tanks, and more particularly to a device for reducing the release of vapors to atmosphere through the open slots of a gauge well in a floating roof tank.

Floating roof tanks are in widespread use for the storage of volatile stock materials, particularly petroleum products. In order to enable the level of the material in a tank to be measured, the tank is provided with a gauge well that generally comprises a vertical tube that is disposed within the tank adjacent its shell, i.e. side wall. The gauge well is fixed in position within the tank, and as the floating roof of the tank moves up and down with the level of the stock stored therein, it slides along the gauge well.

In order to permit accurate sampling of the stock within the tank, the gauge well is provided with slots spaced along its length. It may be desirable to obtain samples of the stock at various levels within the tank, for example prior to sale of the contents of the tank. A reading of the stock at these levels can be obtained with a sampling device that is lowered into the gauge well to the desired levels. If the slots were not provided along its length, then some other means of sampling would be required since the liquid within the gauge well would only be representative of that at the bottom of the tank where it entered the gauge well.

Since the gauge well, and more particularly the slots therein, provide an opening to atmosphere through which vapors from the liquid stock can escape, it is desirable, and in fact required under some environmental control restrictions, to restrict these vaporous emissions. This has typically been done by means of a float disposed within the gauge well. The float rides up and down within the gauge well and effectively limits the surface area of the liquid within the gauge well from which evaporation can occur.

While the gauge well float is effective in reducing evaporation from floating roof tanks, the designs of those used heretofore have presented some practical difficulties. To facilitate removal of the float from the gauge well when a sample of the stock is to be taken, a chain is attached at one end to the float and at the other end to the top of the gauge well, for example its hatch. The length of the chain is at least equal to the depth of the gauge well. When the float is disposed near the middle of the gauge well, for example, it will be appreciated that there is substantial slack in the chain. Sometimes the chain can get caught on burrs that are formed when the slots are cut into the well. More typically, however, the slack portion of the chain gets blown outside of the gauge well slots by the wind, where it kinks and gets caught. In either case, when the chain gets hung up in this manner it can result in the float being suspended above the level of the liquid stock. Alternatively, when the chain is caught it can hold the float down, causing it to be submerged when the tank is filled. In both of these situations the purpose of the float is defeated.

In the past, the gauge well float comprised a hollow cylindrical cannister constructed of metal components, typically bronze, that were welded, brazed or soldered together. Since many of the liquid materials that are commonly stored in floating roof tanks have a corrosive effect on the metal float, the float can develop leaks after a period of contact with the stock. More particularly, the joints between the components can crack or become corroded. When a float with cracks or the like is submerged as described above, it fills with the liquid and no longer becomes an effective deterrent to evaporation, even if the chain is subsequently freed.

Another problem associated with prior types of gauge well floats is presented by the burrs that are on the inside wall of the gauge well. Specifically, the edges of the float often get caught on them, resulting in the float being hung up within the gauge well above the level of the stock. Consequently, if there are any gauge well slots present between the float and top of the liquid, evaporation will not be prevented or reduced.

OBJECTS AND BRIEF SUMMARY OF THE INVENTION

It is therefore a general object of the present invention to provide a novel float system for a gauge well that avoids the aforementioned problems of prior art floats.

It is a more particular object of the present invention to provide a novel gauge well float system that eliminates the need for a chain connected between a float and the top of the gauge well, and thereby avoids the problems associated therewith.

It is another object of the present invention to provide a novel gauge well float system that remains centered within a gauge well as it moves up and down, and is therefore less likely to get hung up on the burrs that are commonly present on the interior of a gauge well.

The present invention achieves these and other objects, and their attendant advantages, by providing a novel gauge well float system in which the float includes a sealed cylinder with tapered ends, preferably rounded or hemispherical. A tube is disposed along the vertical axis of the cylinder and held in place by the rounded ends. A weighted cable is suspended in the gauge well, and passes through the tube in the float. The cable keeps the float centered in the gauge well and provides a means for removing the float from the gauge well when a sampling or level measurement is to be carried out. The weighted cable is not as likely to get caught in the gauge well slots as a chain, and the centering of the float that it provides, coupled with the rounded ends of the cylinder, substantially reduces the likelihood of the float getting caught or hung up within the gauge well.

Further appreciation of the manner in which the present invention provides these advantages can be gained from a perusal of the following detailed description of a preferred embodiment of the invention illustrated in the accompanying drawings.

DETAILED DESCRIPTION

Figure 1:
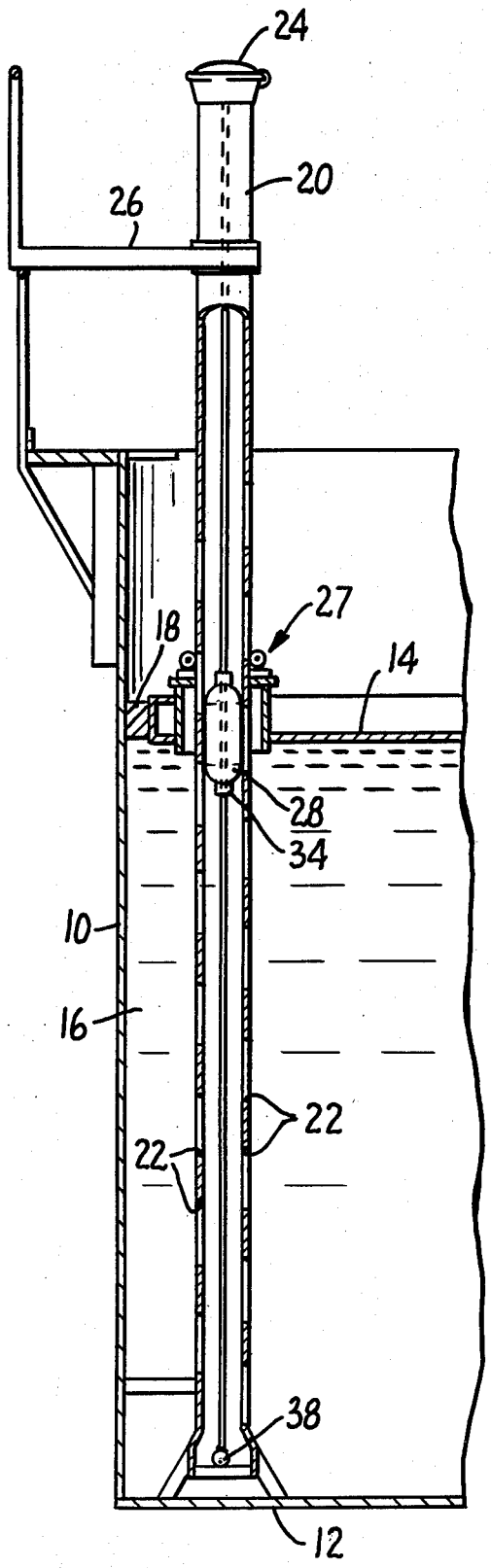
FIG. 1 is a cross-sectional side view of a floating roof tank illustrating the gauge well float in a normal operating position.
Figure 2:
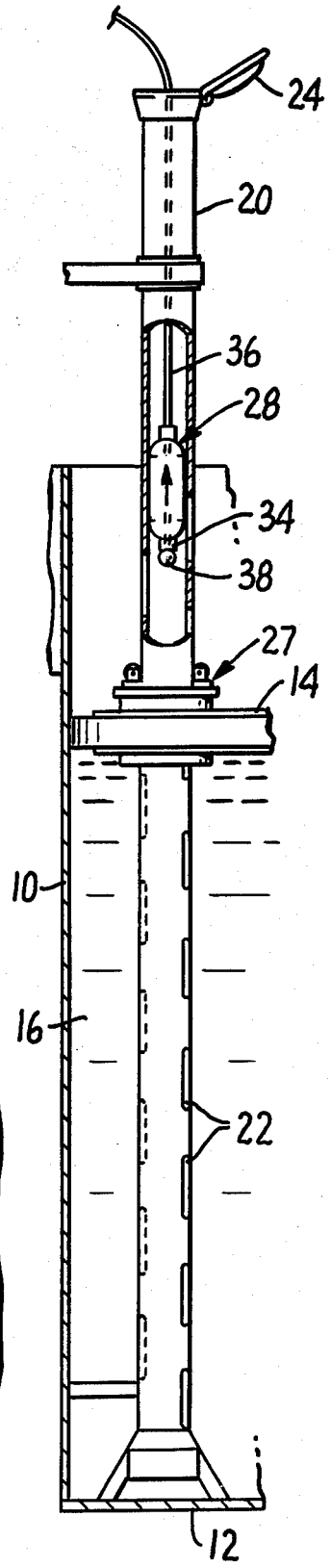
FIG. 2 is a cross-sectional side view similar to FIG. 1, illustrating the float being raised to enable a sampling or level measurement to be made.
Figure 4:
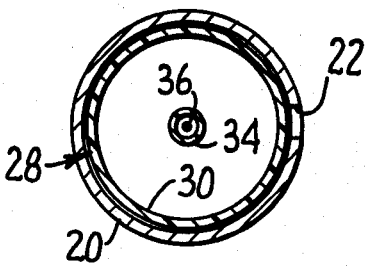
FIG. 4 is a cross-sectional top view of the gauge well float.

Referring now to FIGS. 1 and 2, a conventional floating roof tank includes a cylindrical shell or side wall 10 and an integral floor 12. A roof 14 is provided with bouyant supports (not shown) that enable it to float upon the liquid stock 16, e.g. gasoline or other petroleum products, in the tank. The outer periphery of the roof 14 is provided with a circumferential seal 18 of any suitable conventional type that prevents rain or other elements from getting into the stock 16, as well as inhibits evaporation of the stock through the space between the roof 14 and the shell 10.

The tank is provided with a gauge well 20 located adjacent the shell 10 to permit access to the stock 16 through the roof 14. The gauge well basically comprises a vertical pipe that may be about 6–12 inches in diameter, for example, and that is supported above the floor 12 of the tank. Longitudinal slots 22 are spaced along the length of the gauge well to permit the stock 16 at various levels within the tank to enter the gauge well and be present at those levels for sampling purposes. The top of the gauge well is closed off by a suitable hatch 24 that can be hinged or otherwise fitted thereto. A cutout is provided in the roof to accommodate the gauge well, and a suitable sealing and roller device 27 is provided to seal off the gap between the opening and the outside of the gauge well, as well as permit the roof to easily move relative to the gauge well.

To enable a liquid sample to be taken or a level measurement to be made through the gauge well, a platform 26 is provided at the top of the tank so that an operator can stand at the top of the gauge well and lower a sampling device into the gauge well, or take a reading from a measuring device located at the bottom of the tank, for example. Access to the platform can be obtained by means of stairs or a ladder (not shown) on the side of the tank.

Figure 3:
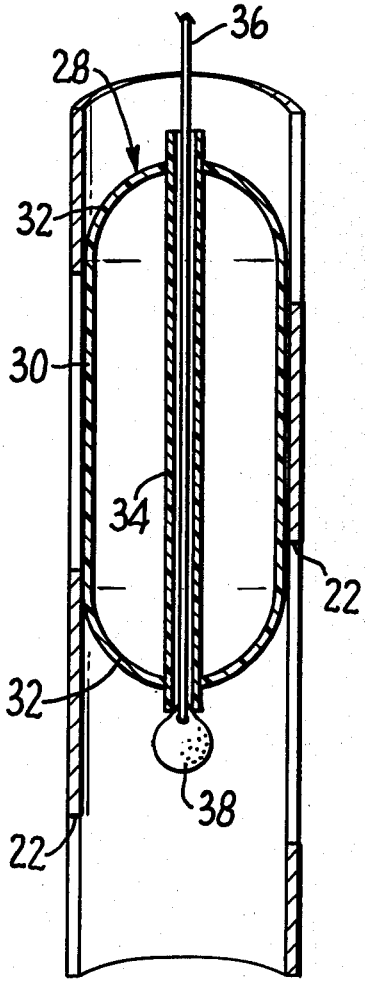
FIG. 3 is detailed cross-sectional side view of the gauge well float as it is being raised, as depicted in FIG. 2.

It will be appreciated that the slots 22 located above the level of the floating roof 14 provide an open path between the atmosphere and the surface of the liquid within the gauge well. In order to reduce evaporations through these openings, a float 28 is disposed within the gauge well to effectively limit the area of the liquid surface in the gauge well that is exposed to atmosphere. Such a float, constructed in accordance with the principles of the present invention, is illustrated in greater detail in FIG. 3.

The float 28 includes a cylinder 30 having rounded ends 32. In a preferred embodiment of the invention, the cylinder is made from polyvinylchloride (PVC) material, for example a sheet of PVC between about 1/16 inch and ¼ inch thick that is rolled and welded. The outside diameter of the cylinder is sufficiently close to the inside diameter of the gauge well so as to satisfy environmental control requirements. The rounded ends 32 are hemispherical PVC end caps that are welded to the opposite ends of the cylinder. It is feasible to use end caps having other shapes as well, e.g. conical, so long as they provide some form of taper at each end of the float.

An elongated narrow tube 34 is provided along the central axis of the cylinder 30, and protrudes slightly from each of the end caps 32. The tube 34 can be a length of ¼ inch I.D. PVC pipe, for example. All seams on the float are sealed so that it is airtight and therefore bouyant. If desirable, the inside of the float can be filled with a material such as styrofoam, to thereby render it unsinkable.

A flexible cable 36, for example a ⅛ inch stainless steel wire or cable, is suspended within the gauge well 20 and passes through the bore formed by the tube 34. The top end of the cable can be attached to the underside of the hatch 24. The cable is slightly shorter in length than the gauge well, and a weight 38 is attached to the bottom end thereof. The cable hangs freely within the gauge well and the weight keeps it taut and centered therein. The weight is larger in diameter than the inside diameter of the tube 34. When the cable is pulled from the top of the hatch, the weight engages the bottom of the float and causes it to be removed from the gauge well. In this regard, the weight need not be a separate element as shown in the drawings, but rather can be any suitable arrangement that prevents the end cable from being drawn through the tube 34 and centers the cable in the gauge well.

In operation, the floating roof 14 moves up or down, sliding along the gauge well, as the tank is filled or drained, respectively. The float 28 within the gauge well floats on the surface of the stock 16, sliding along the cable 36 with changes in the level of the stock, and thus always remains at the level of the roof 14, as shown in FIG. 1. The close tolerance between the outside diameter of the float and the inside diameter of the gauge well limits the exposed surface of the stock, from which evaporations can take place, to a very small area. The centering of the float provided by the cable, in combination with its rounded or tapered ends, diminishes the likelihood that the float will get caught on burrs or other obstructions on the interior of the gauge well. In addition, since the cable remains centered by the weight, it is less likely to get caught in the slots.

When it is desired to remove the float from the gauge well in order to measure the level of the stock or take samples therefrom, the operator merely has to open the hatch 24 and pull the cable 36 up out of the gauge well. When the weight 38 engages the bottom of the float, it will cause the float to be pulled up and out of the gauge well, as illustrated in FIG. 2.

The present invention can be embodied in other specific forms without departing from the spirit or essential characteristics thereof. For example, although the float has been disclosed as comprised of PVC material, other suitable materials that float, such as other plastics, wood or metal, can be employed. In addition, it can be solid instead of a hollow cylinder that is optionally filled with an unsinkable material. For example, it might be a solid block of wood with a central longitudinal bore to accommodate the cable.

The presently disclosed embodiment is therefore considered in all respects to be illustrative and not restrictive. The scope of the invention is indicated by the appended claims, rather than the foregoing description, and all changes that come within the meaning and range of equivalents thereof are intended to be embraced therein.

What is claimed is:

1. In a floating roof tank including a tubular gauge well having a plurality of slots spaced along the length thereof to permit sampling of the liquid at various levels in the tank, a device for minimizing evaporation through any of the gauge slots that are located above the level of the liquid while being adapted to be readily removed to enable samples of stock in the tank to be taken through the gauge well, comprising:

a float comprised of a cylindrical member having tapered, closed ends, said float having an outside diameter that is substantially the same as the inside diameter of the gauge well;

an elongated inner cylindrical wall forming a bore along the vertical axis of said float; and a cable having one end thereof attached to the top of said gauge well so as to be suspended in the center thereof, and weight attached to its other end near the bottom of said gauge well, said cable passing through said bore to thereby center said float in the gauge well and said weight engaging said float when the cable is pulled out of the gauge well.

2. The device of claim 1 wherein the ends of said float are rounded.

3. The device of claim 1 wherein said float is filled with a bouyant material.

4. The device of claim 3 wherein said bouyant material is styrofoam.

5. The device of claim 1 wherein said inner cylindrical wall is provided by the interior of a tube connected between said closed ends.

6. A floating roof tank including:

a gauge well having slots spaced along its length to permit sampling of liquid at various levels within the tank;

a hatch at the top of said gauge well;

a cable having a length slightly less than that of said gauge well, said cable being attached at one end to said hatch and being suspended within said gauge well;

a cylindrical float disposed within said gauge well, said float having an inner cylindrical wall forming a vertical bore along its central axis through which said cable passes, and a diameter that is substantially the same as the inside diameter of said gauge well to inhibit the evaporation of liquid through any of the gauge well slots located above the liquid; and means at the bottom end of said cable for engaging said float when said cable is pulled out of said gauge well.

7. The floating roof tank of claim 6 wherein said float comprises a hollow sealed cylinder and said bore is provided by a tube connected between the ends of said cylinder.

8. The floating roof tank of claim 6 wherein said means comprises a weight attached to the bottom end of said cable.

* * * * *